United States Patent [19]

Emery

[11] 4,369,887

[45] Jan. 25, 1983

[54] MERCHANDIZING RACK

[75] Inventor: Merton D. Emery, Grand Haven, Mich.

[73] Assignee: Harbor Industries, Inc., Grand Haven, Mich.

[21] Appl. No.: 83,802

[22] Filed: Oct. 11, 1979

[51] Int. Cl.[3] ..... A47F 3/14

[52] U.S. Cl. ..... 211/49 D; 211/51; 211/133

[58] Field of Search ..... 211/49 D, 51, 128, 50, 211/132, 133; 312/42, 71

[56] References Cited

U.S. PATENT DOCUMENTS

| | | | |
|---|---|---|---|
| 740,927 | 10/1903 | Roberts . | |
| 917,705 | 4/1909 | Benjamin | 211/128 X |
| 1,151,402 | 8/1915 | Rowell . | |
| 1,587,936 | 6/1926 | Brunhoff . | |
| 2,129,122 | 6/1938 | Follett | 211/49 D |
| 2,145,563 | 1/1939 | Watson | 312/71 |
| 2,228,775 | 1/1941 | Morgan | 211/128 |
| 2,385,603 | 9/1945 | Bloom | 211/50 |
| 2,443,862 | 6/1948 | Justus | 312/70 |
| 2,492,912 | 12/1949 | Womack | 312/45 |
| 2,923,414 | 2/1960 | Laughton | 211/49 D |
| 3,028,014 | 4/1962 | Southwick | 211/49 D |
| 3,224,822 | 12/1965 | Kirby | 312/71 |
| 3,298,568 | 1/1967 | Le Brocq | 221/155 |
| 3,643,808 | 2/1972 | Ryan | 211/49 D |
| 3,780,873 | 12/1973 | Silva | 211/49 D |
| 4,006,824 | 2/1977 | Snediker et al. | 211/49 D |

*Primary Examiner*—Roy D. Frazier
*Assistant Examiner*—Robert W. Gibson, Jr.
*Attorney, Agent, or Firm*—Price, Heneveld, Huizenga & Cooper

[57] ABSTRACT

A merchandising rack for displaying and dispensing a plurality of generally planar upright product packages comprises a forwardly inclined ramp adapted for receiving a first linear array of the product to be dispensed. A product carrying container is slidably received on the ramp. The product carrying container defines a parallelpiped having an angle of inclination approximately equal to the slope angle of the inclined ramp. The container is adapted for receiving a second linear array of the product and backing up the first linear array of the product to gravity bias the same in the forward direction for viewing and dispensing. Stop means is disposed at the front of the ramp for engaging the foremost members of the first linear array of the product and the gravity biasing container when the first linear array of the product is exhausted.

34 Claims, 8 Drawing Figures

MERCHANDISING RACK

BACKGROUND OF THE INVENTION

The merchandising rack of the present invention relates generally to merchandising displays for a plurality of generally planar upright items. More particularly, the invention is directed to an inclined ramp type of merchandising rack having a gravity biasing product filled container.

Prior merchandising racks have employed inclined ramps in which a plurality of generally planar identical items were stacked in a linear array. In many cases, the weight of the items themselves were employed to gravity bias the linear array in the forward direction. However, as an increasing number of items were dispensed from these prior art displays, the remaining merchandise often became jumbled, presenting an unkempt and undesirable display. This problem was met in the prior art by using a variety of different spring biasing mechanisms for urging the product array forward or by backing up the product array with a sliding gravity biasing weight. Problems with these prior art arrangements stem from the expense of providing a mechanical spring mechanism and the space penalty that is paid for a gravity biasing weight.

Display racks are found in the prior art wherein a plurality of rectangular shipping containers are disposed on a forwardly inclined ramp. The tops of the shipping containers are opened and as the product disposed in the foremost shipping container is exhausted, the shipping container is removed to allow a second shipping container to slide downward along the ramps to a dispensing position. These shipping containers do nothing to enhance the aesthetic appearance of the display and when one of the containers is partially exhausted of the product being dispensed therefrom, there is nothing to prevent the remaining product contained within the container from becoming unkempt and disorderly in appearance.

SUMMARY OF THE INVENTION

The present invention solves these and other problems in the prior art by provision of a merchandising rack for displaying and dispensing a plurality of generally planar upright product packages comprising a forwardly inclined ramp adapted for receiving a first linear array of the product. A product carrying container adapted for receiving a second linear array of the product is then slidably received on the ramp. The product carrying container backs up the first linear array of the product to gravity bias the same forward to a position where the product may be viewed and dispensed. Stop means is disposed at the front of the ramp for engaging the first linear array of the product and the container when the first linear array of the product is exhausted. As the product in the first linear array of the product is dispensed the container slides down the ramp gravity biasing the remainder of the first linear array of the product forward in an orderly upstanding fashion. As the first linear array of the product is exhausted, the container comes to rest on the stop means disposed on the front of the inclined ramp. At this point, the second linear array of the product contained within the gravity biasing container is dispensed from the front of the gravity biasing container until the second linear array of the product is exhausted. The container is structured so that even when only a few items remain in the second linear array of the product, these few items remain upright in a relatively orderly fashion within the container. Normally a plurality of ramps are disposed at various elevations in an integral display case structure. The merchandising rack of the present invention eliminates complex mechanical spring mechanisms with a simple cost savings arrangement which effectively weight biases a linear product array in a generally upright position without paying a space penalty for a gravity biasing weight.

DESCRIPTION OF THE PREFERRED EMBODIMENTS

Figure 1:
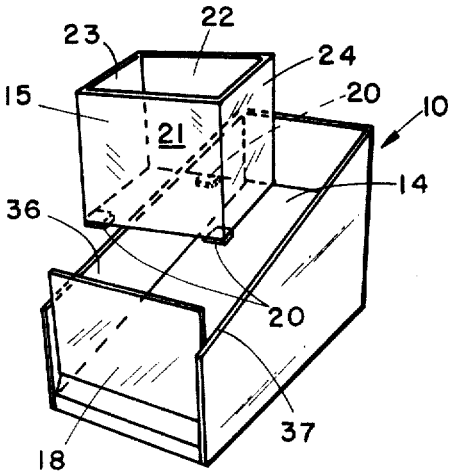
FIG. 1 is an exploded assembly of the merchandising rack of the present invention.
Figure 2:
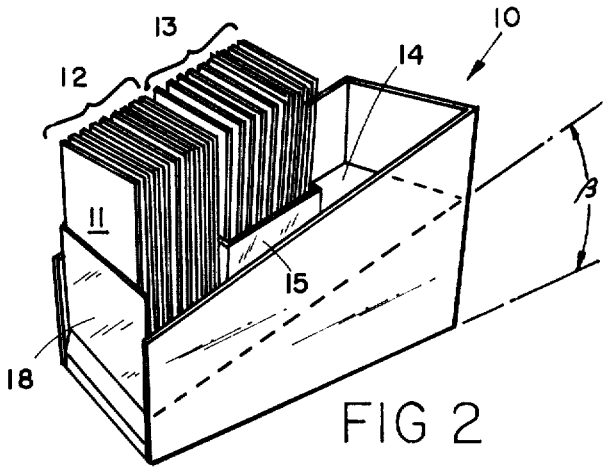
FIG. 2 is a perspective view of the merchandising rack of the present invention.

Referring to FIGS. 1 and 2, a merchandising rack 10 is provided for displaying and dispensing a plurality of generally planar upright product packages 11. The merchandising rack 10 includes a forwardly inclined ramp 14 for receiving a first linear array of the product 12. A product carrying container 15 slidably engages the ramp 14. The container 15 receives a second linear array of the product 13. The container 15 and the second linear array of the product 13 retained therein backs up the first linear array of the product 12 to gravity bias the same in a forward direction for viewing and dispensing of the product. Stop means comprising transparent window 18 is disposed at the front of the ramp 14 for abutting the foremost members of the first linear array of the product 12 and the container 15 when the first linear array of the product 12 is exhausted.

Figure 3:
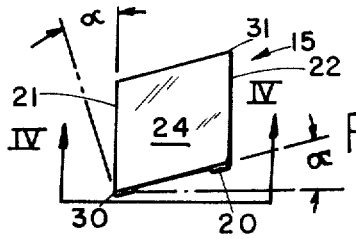
FIG. 3 is an elevational view of the gravity biasing product filled container of the present invention.
Figure 5:
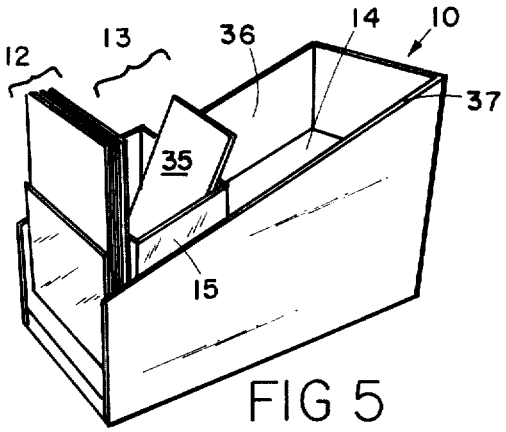
FIG. 5 is another perspective view of the merchandising rack of the present invention.
Figure 4:
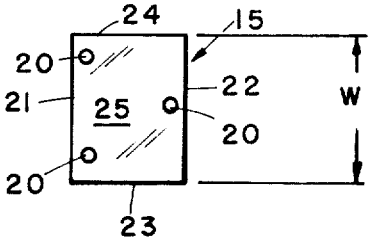
FIG. 4 is a bottom view taken along lines IV—IV of FIG. 3 of the gravity biasing product filled container of FIG. 2.

Preferably the ramp 14 is formed from a material having a hard planar surface and container 15 separately illustrated in FIGS. 3 and 4 is provided with antifriction means for facilitating relative movement between the ramp 14 and the container 15. In this case, the antifriction means comprises an array of Teflon pads 20 suitably secured to the bottom of the container 15. Preferably, the container 15 is comprised of a front wall 21, a rear wall 22, a first sidewall 23, a second sidewall 24 and a bottom 25 defining a parallelepiped having an angle of inclination $\alpha$ approximately equal to the slope angle $\beta$ of the ramp 14. Preferably, all four walls and the bottom of the container 15 are also formed from a transparent material. The container 15 is dimensioned such that the distance between the first and second sidewalls 23 and 24 is approximately equal to or greater than the expected width of the product 11 to be contained therein. This insures that the second linear array of the product 13 retained within container 15 remains in a single orderly array. Also, the container is dimensioned such that the diagonal distance between the bottom 30 of the front wall 21 and the top 31 of the rear wall 22 is greater than the height of the product 11. As best illustrated in FIG. 5, this insures that the last item 35 disposed in the container 15 remains in an upright position. The inclined ramp 14 further includes opposing sidewalls 36 and 37 separated by a distance approximately equal to or slightly greater than the width W of the product container 15 to insure the side to side stability of the first linear array of the product 12 and the container 15 slidably received on the ramp 14.

It should be clear that when filling the merchandising rack 10 of the present invention, the first linear array 12 and the second linear array 13 contained within gravity biasing product filled container 15 will completely fill the length of the ramp 14. Thus, the gravity biasing container 15 generates an effective forward biasing force for the first linear array 12 without the space penalty previously paid by mechanical spring biasing arrangements and gravity biasing weights. Furthermore, as best illustrated in FIG. 5, the gravity biasing container 15 keeps the first linear array of the product 12 in an upright orderly fashion by sliding down the ramp 14 until the first linear array of the product 12 is gradually exhausted. Thereafter, the product remaining in the second linear array 13 contained within gravity biasing container 15 is dispensed in an orderly fashion until a single upstanding item such as the item 35 remains within the product carrying container 15.

Figure 6:
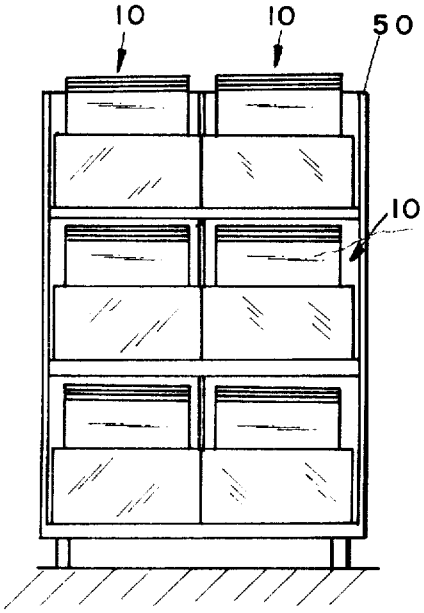
FIG. 6 is a front elevational view of a merchandising display formed from a plurality of the merchandising racks of the present invention.
Figure 7:
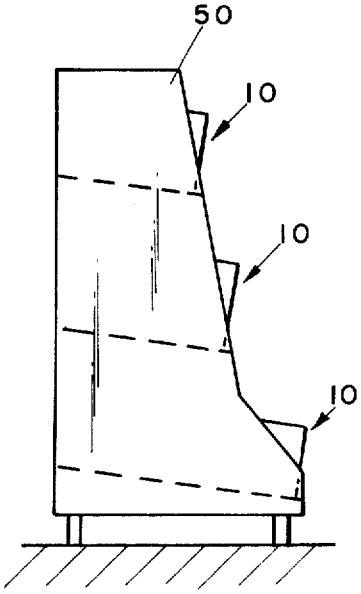
FIG. 7 is a side elevational view of another merchandising display constructed according to the present invention.
Figure 8:
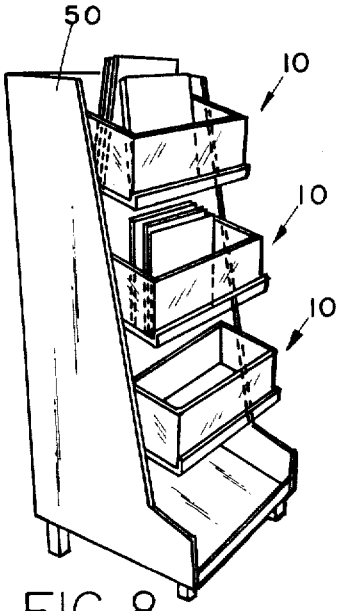
FIG. 8 is a perspective view of another merchandising display constructed according to the present invention.

Referring to FIGS. 6 through 8 it is illustrated that a plurality of merchandising racks 10 may be disposed in a support structure 50 with the merchandising racks disposed one above the other and/or one beside the other to form a merchandising display.

The above description should be considered as exemplary and that of the preferred embodiment only. The true spirit and scope of the present invention should be determined by reference to the appended claims. It is desired to include within the appended claims all modifications of the invention that come within the proper scope of the invention.

The embodiments of the invention in which an exclusive property or privilege is claimed are defined as follows:

1. A merchandising rack for displaying and dispensing a plurality of generally planar upright product packages comprising:

a forwardly inclined ramp adapted for receiving a first linear array of the product, said ramp comprising a hard planar surface;

a product carrying container slidably engaging said ramp, said container being adapted for receiving a second linear array of the product and backing up the first linear array of the product to gravity bias the first linear array of the product forward for viewing and dispensing of the product, said container being provided with an array of anti-friction means comprising an array of Teflon pads; and stop means disposed at the front of said ramp for engaging the first linear array of the product and said container when the first linear array of the product is exhausted.

2. The merchandising rack of claim 1 wherein said container is provided with a flat closed bottom, at least three of said pads being disposed thereon.

3. The merchandising rack of claim 1 wherein said container is formed from a transparent material.

4. The merchandising rack of claim 1 wherein said stop means comprises an upright transparent wall disposed on the front of said ramp.

5. The merchandising rack of claim 1 wherein said container is comprised of:

a front wall;

a rear wall;

a first sidewall; and a second sidewall;

said walls defining a parallelepiped having an angle of inclination approximately equal to the slope angle of said ramp.

6. The merchandising rack of claim 5 wherein the distance separating the bottom of said front wall and the top of said rear wall of said continer is less than the expected height of the product to be contained therein.

7. The merchandising rack of claim 5 wherein the distance separating said first and second sidewalls of said container is approximately equal to or slightly greater than the expected width of the product to be contained therein.

8. The merchandising rack of claim 5 wherein at least the front wall of said container is transparent.

9. The merchandising rack of claim 7 wherein said ramp further includes first and second opposing sidewalls, said first and second opposing sidewalls being separated by a distance equal to or slightly greater than the width of said container.

10. The merchandising rack of claim 1 wherein a plurality of said merchandising racks are disposed in a support structure one above the other to form a merchandising display.

11. The merchandising rack of claim 1 wherein a plurality of said merchandising racks are disposed in a support, one beside another, to form a merchandising display.

12. In a merchandising display of the type including a forwardly inclined ramp having a hard planar surface for displaying and dispensing a first linear array of generally planar upright product packages and stop means engaging the frontmost product package of the first linear array of product packages, the improvement comprising:

a product carrying container slidably engaging said ramp, said container being provided with an array of anti-friction means comprising a plurality of Teflon pads, said container being adapted for receiving a second linear array of the product and backing up the first linear array of the product to gravity bias the same forward for viewing and dispensing.

13. The merchandising rack of claim 14 wherein said container is provided with a flat closed bottom, at least three of said pads being disposed thereon.

14. The merchandising rack of claim 12 wherein said container is formed from a transparent material.

15. The merchandising rack of claim 12 wherein said stop means comprises an upright transparent wall disposed on the front of said ramp.

16. The merchandising rack of claim 12 wherein said container is comprised of:

a front wall;

a rear wall;

a first sidewall; and a second sidewall;

said walls defining a parallelepiped having an angle of inclination approximately equal to the slope angle of said ramp.

17. The merchandising rack of claim 16 wherein the distance separating the bottom of said front wall and the top of said rear wall of said container is less than the expected height of the product to be contained therein.

18. The merchandising rack of claim 16 wherein the distance separating said first and second sidewalls of said container is approximately equal to or slightly greater than the expected width of the product to be contained therein.

19. The merchandising rack of claim 16 wherein at least the front wall of said container is transparent.

20. The merchandising rack of claim 18 wherein said ramp further includes first and second opposing sidewalls, said first and second opposing sidewalls being separated by a distance equal to or slightly greater than the width of said container.

21. The merchandising rack of claim 12 wherein a plurality of said merchandising racks are disposed in a support structure one above the other to form a merchandising display.

22. The merchandising rack of claim 12 wherein a plurality of said merchandising racks are disposed in a support, one beside another, to form a merchandising display.

23. A merchandising rack for displaying and dispensing a plurality of generally planar upright product packages comprising:

a forwardly inclined ramp having a hard planar surface forming a slope angle with respect to the horizontal, said ramp being adapted for receiving a first linear array of the product;

a four sided, closed bottom, open top product carrying container slidably engaging said ramp, said container being adapted for receiving a second linear array of the product to gravity bias the first linear array of the product forward for viewing and dispensing of the product;

said container forming a parallelepiped having an angle of inclination approximately equal to the slope angle of said ramp;

an array of anti-friction means disposed on the bottom of said container comprising an array of pads for raising said product carrying container above said hard planar surface of said ramp and lowering the coefficient of friction between said container and said ramp;

stop means disposed at the front of said ramp for engaging the foremost product package of the first linear array of product and said container when the first array of the product is exhausted.

24. The merchandising rack of claim 23 wherein said anti-friction means comprises an array of Teflon pads disposed on the bottom of said container.

25. The merchandising rack of claim 24 wherein at least three of said pads are provided.

26. The merchandising rack of claim 24 wherein said container is formed from a transparent material.

27. The merchandising rack of claim 24 wherein said stop means comprises an upright transparent wall disposed on the front of said ramp.

28. The merchandising rack of claim 24 wherein said container comprises a front wall, a rear wall, a first sidewall, and a second sidewall.

29. The merchandising rack of claim 28 wherein the distance separating the bottom of said front wall and the top of said rear wall of said container is less than the expected height of the product to be contained therein.

30. The merchandising rack of claim 28 wherein the distance separating said first and second sidewalls of said container is approximately equal to or slightly greater than the expected width of the product to be contained therein.

31. The merchandising rack of claim 28 wherein at least the front wall of said container is transparent.

32. The merchandising rack of claim 30 wherein said ramp further includes first and second opposing sidewalls, said first and second opposing sidewalls being separated by a distance equal to or slightly greater than the width of said container.

33. The merchandising rack of claim 23 wherein a plurality of said merchandising racks are disposed in a support structure one above the other to form a merchandising display.

34. The merchandising rack of claim 23 wherein a plurality of said merchandising racks are disposed in a support, one beside another, to form a merchandising display.

* * * * *